United States Patent [19]

Tronc

[11] 4,314,218

[45] Feb. 2, 1982

[54] MAGNETIC SYSTEM FOR REARRANGING OR REGROUPING CHARGED PARTICLES WITHIN A PULSED BEAM

[75] Inventor: Dominique Tronc, Paris, France

[73] Assignee: CGR-MeV, Buc, France

[21] Appl. No.: 102,900

[22] Filed: Dec. 12, 1979

[30] Foreign Application Priority Data

Dec. 15, 1978 [FR] France ..... 78 35383

[51] Int. Cl.[3] ..... H05B 31/26; H05H 1/10

[52] U.S. Cl. ..... 335/210; 250/396 ML; 315/111.81; 328/230

[58] Field of Search ..... 335/210; 328/230; 250/396 ML; 315/111.8

[56] References Cited

U.S. PATENT DOCUMENTS 3,379,984 4/1968 Pinel ..... 328/230
3,659,236 4/1972 Whitehead, Jr. ..... 335/210
3,867,635 2/1975 Brown et al. ..... 335/210 X
3,967,225 6/1976 Heighway ..... 335/210

*Primary Examiner*—Robert J. Hickey
*Attorney, Agent, or Firm*—Cushman, Darby & Cushman

[57] ABSTRACT

Magnetic system making it possible to obtain from a pulsed electron beam supplying bunches of electrons of density $d_o$, a pulsed beam formed from electron groups of density $k\ d_o$, said result being obtained by converting the variation of the momentum of the electrons emitted during the time $\Delta t$ of the pulse into a length variation of the paths of said electrons, resulting in regrouping or rearrangement of the electrons within the bunch. This magnetic system has at least one electromagnet equipped with several pairs of pole pieces A, B, D defining a succession of air gaps in which are created, by means of at least one annular coil disposed therein, magnetic fields of different values.

7 Claims, 10 Drawing Figures

MAGNETIC SYSTEM FOR REARRANGING OR REGROUPING CHARGED PARTICLES WITHIN A PULSED BEAM

BACKGROUND OF THE INVENTION

The present invention is directed to a compact magnetic deflection system, which makes it possible to obtain from a beam of pulsed accelerated electrons high density electron bunches.

In certain applications, it can be advantageous to be able to transmit to a target for a very short time high density accelerated electron bunches.

The performances of known devices able to supply high density electron bunches are limited by the electronic current value which can be accelerated (for example in the case of a linear electron accelerator operating in the S frequency band, the accelerated peak current cannot exceed a few dozen amperes).

BRIEF SUMMARY OF THE INVENTION

The magnetic deflection system according to the present invention is able to supply high density electron bunches by converting the variation in the momentum of electrons emitted during the time $\Delta t$ of one pulse into a variation in the length of the paths travelled by these electrons.

The present invention therefore provides to a magnetic system for regrouping or rearranging charged particles within a pulsed beam and for obtaining high density particle bunches. The system comprises an electromagnet provided with a plurality of polepieces forming a succession of joined magnetic sectors in which are created magnetic fields of different values, said magnetic sectors presenting to the beam of particles a succession of entry and exit faces, said particles having, in the magnetic system, loop-like paths the respective lengths of which are a function of the value of the momentum q of the particles, said different path length values in the magnetic system enable said particle bunches emerging from said magnetic system to be longitudinally compressed with the incident particle bunches.

BRIEF DESCRIPTION OF THE DRAWINGS

The invention is explained in greater detail hereinafter relative to the non-limitative embodiments described herein and the attached drawings, wherein show.

DETAILED DESCRIPTION OF THE PREFERRED EMBODIMENTS

Figure 1:
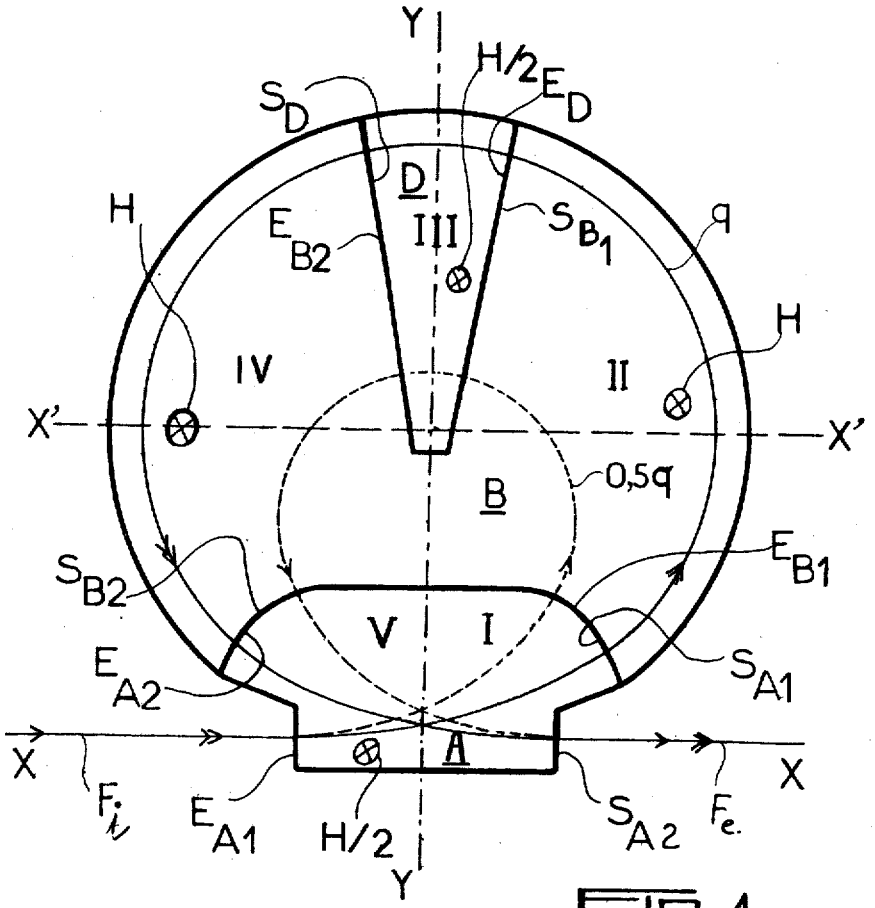
FIG. 1—a magnetic system for regrouping particles in accordance with the invention.

The magnetic deflection system according to the invention shown in FIG. 1 has an electromagnet with three pairs of pole pieces A, B, D having an axis of symmetry YY perpendicular to the incident path XX. The trapezoidal pole pieces D interpenetrate the pole pieces B. Pole pieces A, D, B delimit five successive sectors I, II, III, IV and V in which are successively created the magnetic fields $H_I=H/2$, $H_{II}=H$; $H_{III}=H/2$; $H_{IV}=H$ and $H_V=H/2$.

The different magnetic field values created respectively in the air gaps of pole pieces A, B, D can be obtained by selection of the heights of these air gaps.

The pole piece A of the magnetic system according to the invention defining the sectors I and V offer the incident beam $F_i$ an entry face $E_{A1}$ and to the emergent beam $F_e$ an exit face $S_{A2}$. The other exit face $S_{A1}$ and entry face $E_{A2}$ of said pole pieced A are substantially circular and have a radius equal to:

$$r=R_q \cdot tg(\alpha_q/2) \tag{1}$$

Figure 3:
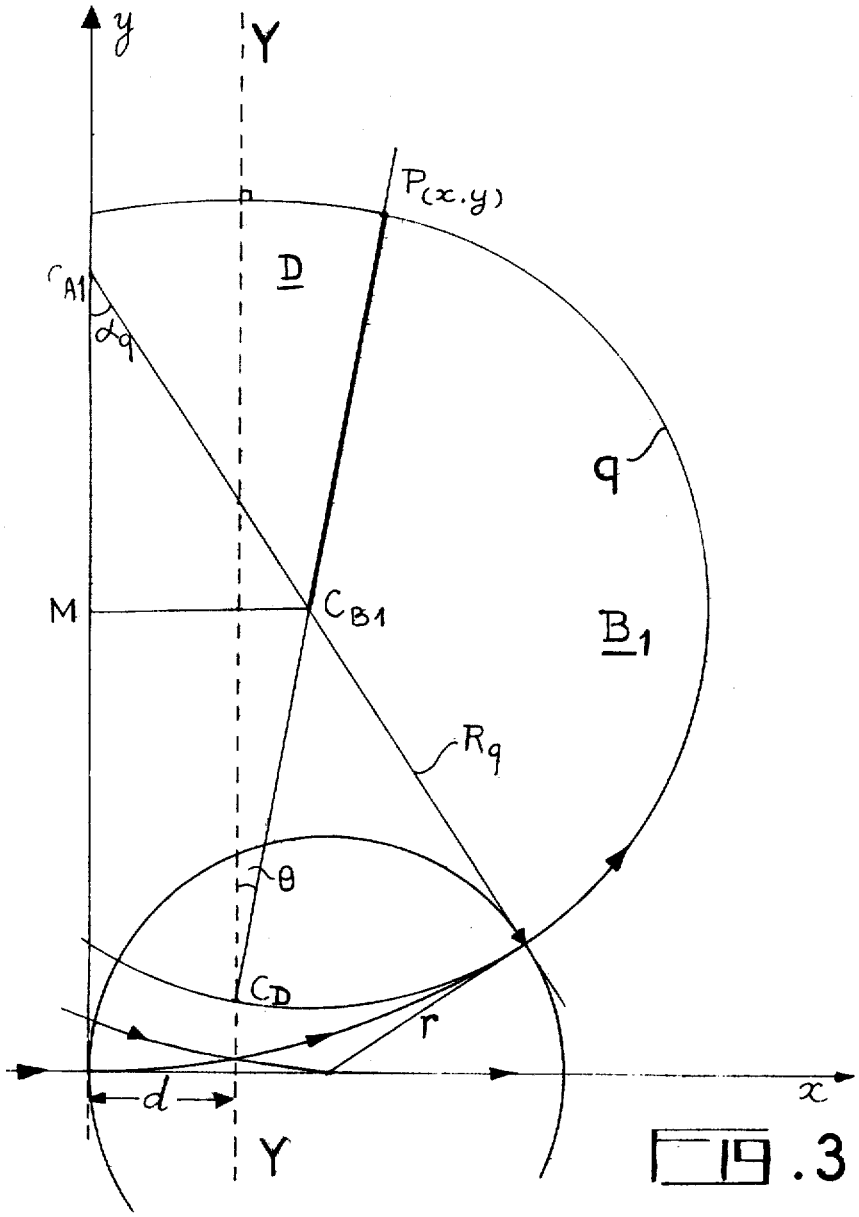
FIG. 3—the geometrical construction of the various pole-pieces used in the magnetic system according to the invention.

$R_q$ and $\alpha_q$ being respectively the radius of curvature and the deflection angle of the paths in the air gap of polepieces A, their values being a function of the momentum of the electrons and the magnetic field created in said air gap (FIG. 3).

Figure 2:
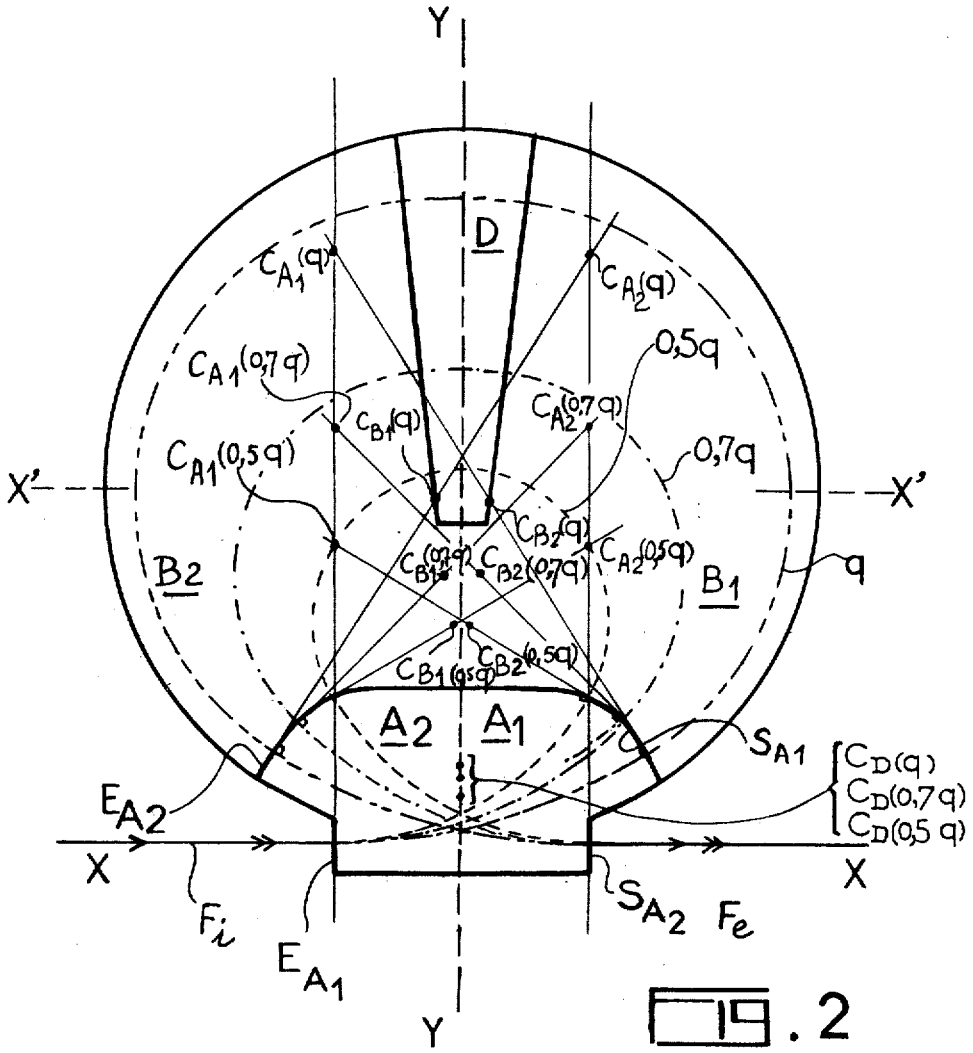
FIG. 2—in detailed manner, the path followed by the electrons having different momentum.

It should be noted that in the embodiment of FIG. 1, the centres of curvature of the particle paths at the exit face $S_{A1}$ and at the entry face $E_{A2}$ of polepieces A are respectively located on straight lines defining the entry face $E_{A1}$ and exit face $S_{A2}$, as shown in FIG. 2 on which are drawn the paths of particles having momentum q, 0.7q, 0.5q. It should also be noted that the centres of curvature $C_{B1}(q)$, $C_{B1}(0.7q)$ and $C_{B1}(0.5q)$ and the centres of curvature $C_{B2}(q)$, $C_{B2}(0.7q)$ and $C_{B2}(0.5q)$ of the paths in polepieces $B_1$ and $B_2$ do not coincide. In zone III, defined by polepieces D, the centres of curvature $C_{Dq}(C_D(q)$; $C_D(0.7q)$; $C_D(0.5q)$ are located on the axis of symmetry YY of the magnetic deflection system (FIG. 3). In the embodiment shown in FIG. 1, the magnetic field created in the air gap of polepieces D (zone III) is equal to half the magnetic field created in zone II. In this case, the conditions indicated hereinbefore are realised and in addition the defocusing of the beam is negligible both in the vertical plane and in the horizontal plane. The choice of the value H/2 of the magnetic field in the air gap of polepieces D makes it possible to satisfy with a good approximation the condition of perpendicularly of the paths to the axis of symmetry YY of the magnetic deflection system, but also to the entry and exit faces of said polepieces D.

Calculation shows that the optimum value of the magnetic field in the air gap of polepieces D is very close to H/2. Thus, on considering that point P (FIG. 3) of the path corresponding to an electron with a momentum q, said point P with coordinates x, y is located on the entry face $E_D$ of the air gap of polepieces D. In cartesian coordinates x, y the following equations are obtained:

$$x = d + 2\,(\overline{C_{B1}M} - d) = R_q \sin \alpha_q - d \tag{2}$$

$$y = R_q - (R_q/2) \cdot \cos \alpha_q + (R_q/2) \cdot \cos \theta \tag{3}$$

d designating the distance between the axis of symmetry YY and the entry face and $\overline{C_{B1}M}$ being the distance between the centre of curvature $C_{B1}$ and axis YY, which is colinear to the entry face $E_{A1}$ and the angle $\theta$ being defined by the equation:

$$\sin\theta = 2(\overline{C_{B1}m} - d)/R_q = \sin\alpha_q - 2d/R_q$$

$$= \sin\alpha_q - 2d/R_q$$

Figure 4:
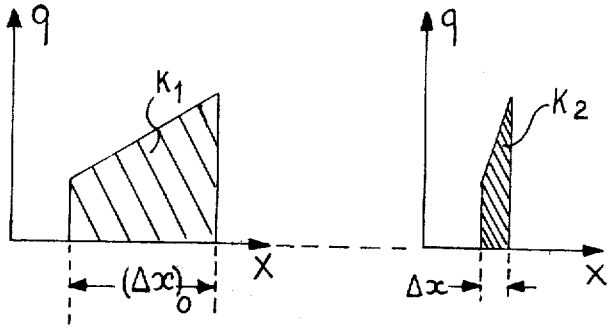
FIG. 4—the modification undergone by a bunch of electrons after passage through the magnetic system according to the invention.

In operation, a bunch $K_1$ of electrons supplied by the particle accelerator during a pulse of duration $\Delta t$ is formed from electrons of momentum between q and 0.5q (FIG. 4). In the magnetic regrouping system according to the invention, this momentum difference is transformed into a path length variation (FIG. 1) and at the exit of the magnetic deflection system, a pulse compressed in the propagation axis XX is obtained, as shown in FIG. 4. Thus, the density of the emergent electron bunch $K_2$ is much higher than density of the incident electron bunch $K_1$.

To illustrate this on considering a pulse of 12 ns delivering a bunch of electrons accelerated to 100 MeV, the initial density of said electron bunch having a value $d_o$, the bunch of electrons obtained at the exit of the deviation magnetic system has a density $4d_o$, the magnetic field created in the air gap of the polepieces B being substantially equal to 0.3 Tesla (the air gap height being equal to 5 cm) and the magnetic field created in the air gaps of polepieces A to D being 0.15 Tesla (air gap height 10 cm).

For these values, the radii of curvature of the paths of electrons of momentum q and 0.67q are respectively equal to $R_q = 1.5$ m and $R_{0.67q} = 3.14$ m In the embodiments described, the mean path of the emergent beam is colinear with the mean path of the incident beam.

Figure 10:
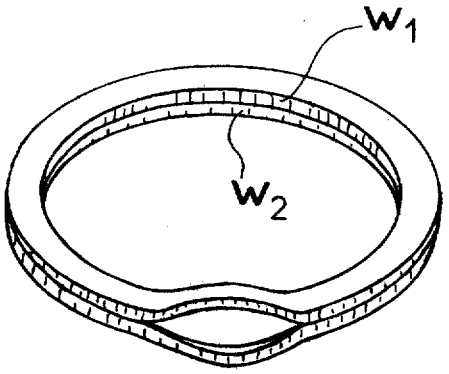
FIG. 10 an embodiments of an annular coil used in the magnetic system according to the invention.
Figure 5:
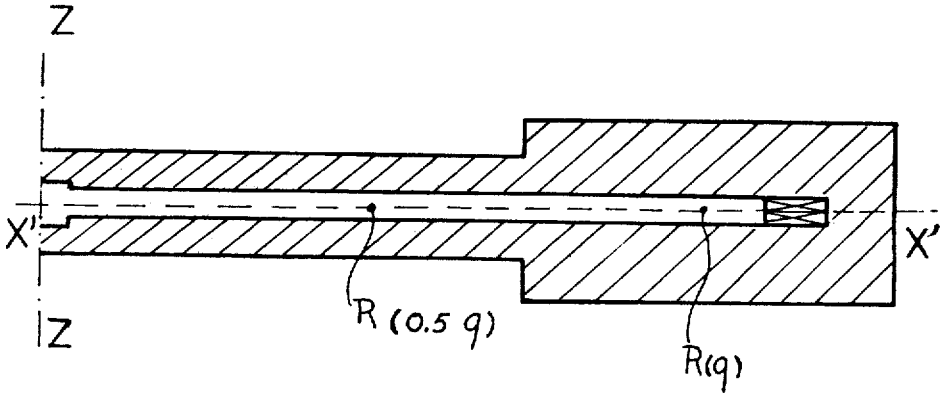
FIGS. 5 and 6—respectively longitudinal sections along two orthogonal axes X'X', YY, a revolution yoke used in an embodiment of a magnetic system according to the invention.
Figure 6:
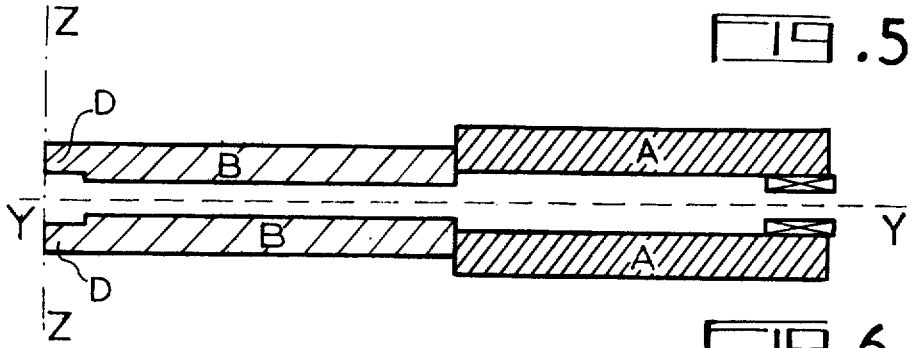

FIGS. 5 and 6 show, in longitudinal section, respectively along axes X'X' and YY, an embodiment of a revolution yoke of the magnetic regrouping or rearranging system according to the invention (axis ZZ being a revolution axis). The annular coil W is positioned in the peripheral zone of the air gaps and thus is constituted by two joined coil elements $W_1$, $W_2$. In the zone corresponding to coil pieces A, these two coil elements $W_1$, $W_2$ shown in FIG. 10 are spaced from one another to permit the passage of the electron beam.

Figure 7:
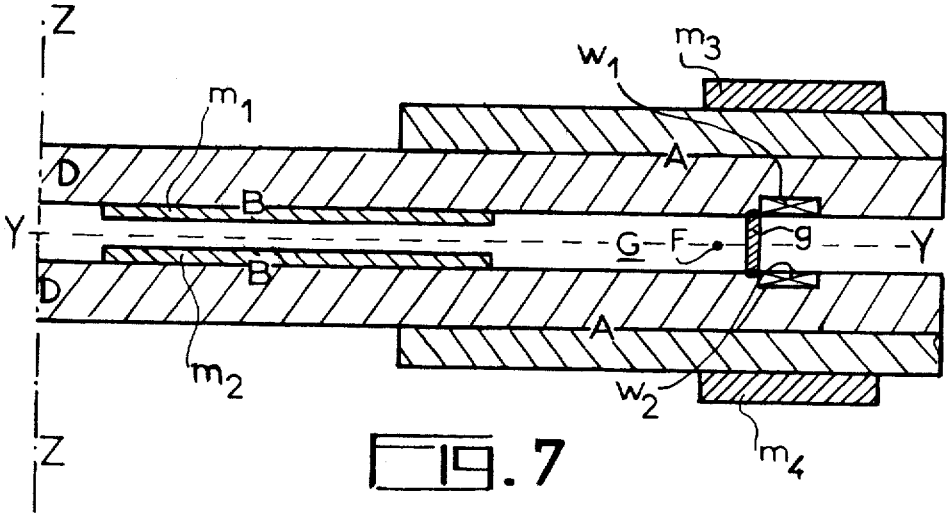
FIGS. 7, 8 and 9—other embodiments of yokes which can be used in the magnetic system according to the invention.

FIG. 7 shows, in a longitudinal section along axis X'X', another embodiment of an electromagnet yoke for the magnetic deflection system according to the invention. Coil elements $W_1$, $W_2$ are positioned outside a vacuum chamber g defined by polepieces A, B, D and a wall g fixed to polepieces A in vacuum-tight manner, wall g being perpendicular to the plane of the particle paths. The reduction in the height of the air gap corresponding to polepieces B is obtained by placing magnetic material elements $m_1$ and $m_2$ in said air gap. Magnetic material elements $m_3$ and $m_4$ are placed on polepieces A on either side of coil W in order to prevent saturation of the polepieces in this zone.

Figure 8:
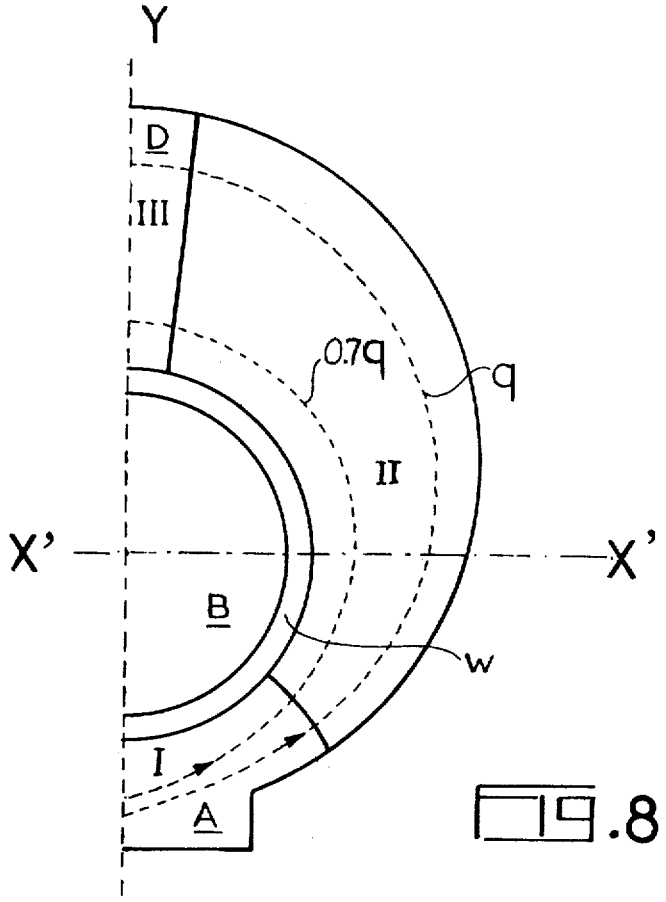
Figure 9:
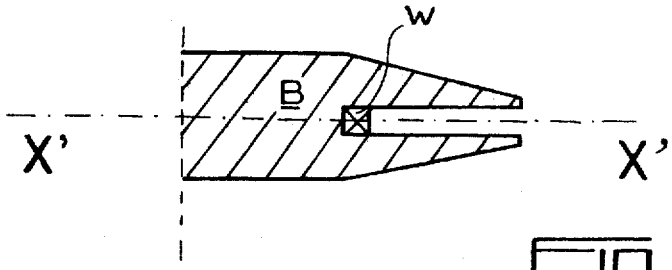

Finally, FIGS. 8 and 9 respectively show in vertical and longitudinal section, along the axis X'X' contained in the plane of the average particle path and passing through the centre of the polepieces, a particularly advantageous yoke construction for the case when the energy variations of the particles (e.g. electrons) within a bunch are less than a coefficient 2. In this embodiment, magnetic coil W is arranged between the polepieces A, B, D in such a way that the paths of the particles are located between coil W and the periphery of the magnetic system.

In the described and represented embodiments of this magnetic system according to the invention, the polepieces have been defined in such a way as to obtain a simple construction of the system, but it is possible to slightly modify the form of the entry and exit faces of polepieces A, B, D and more particularly entry and exit faces $E_D$ and $S_D$ of polepieces D in such a way as to obtain a cross-over of the beam in axis YY in the vertical plane.

Finally, magnetic field overflow beyond the air gaps of polepieces A can be limited in per se manner by means of magnetic material shielding.

What is claimed is:

1. A magnetic system for regrouping or rearranging the charged particles of an incident beam of such particles so as to provide an exit beam having high density particle bunches, comprising:

an electromagnet including first, second and third pairs of polepieces;

the polepieces being arranged so that the polepieces of said first and third pairs interpenetrate the polepieces of said second pair;

all pairs of polepieces having a common plane of symmetry perpendicular to a first axis defined by the average incident and emergent paths of said beam;

the polepieces defining successive air gaps forming successive first, eecond, third, fourth, and fifth sectors in which are created, respectively, a first field $H_I$ having a field strength H/2, a second field $H_{II}$ having a field strength H, a third field $H_{III}$ having a field strength H/2, a fourth field $H_{IV}$ having a field strength H and a fifth field $H_V$ having a field strength H/2, the first sector having an entry face ($E_{A1}$) and an exit face ($S_{A1}$), the second sector having an entry face ($E_{B1}$) and an exit face ($S_{B1}$), the third sector having an entry face ($E_D$) and an exit face ($S_D$), the fourth sector having an entry face ($E_{B2}$) and said exit face ($S_{B2}$), and the fifth sector having an entry face ($E_{A2}$) and an exit face ($S_{A2}$), said entry face ($S_{A1}$) and exit face ($E_{A2}$) being on an arc of a circle having a radius $r = R_q \cdot tg(\alpha_q/2)$, where $R_q$ and $\alpha_q$ represent respectively the radius of curvature and the deflection angle of the paths in the air gap of said first pair of polepieces for elections having a momentum q;

the successive sectors providing a plurality of loop-like paths for an incident beam entering through entry face ($E_{A1}$) and exiting through exit face ($S_{A2}$), the path length of each path being determined as a function of the momentum q of a particle traveling thereon, the different path lengths resulting in the bunching of particles emerging from exit face ($S_{A2}$) so that they are longitudinally compressed with respect to particles incident at entry face ($E_{A1}$); and wherein the electromagnet is provided with an annular coil in the air gap of said first, second, and third polepieces.

2. A magnetic system according to claim 1, wherein said entry and exit faces of each pair of polepieces are substantially perpendicular to the particle paths considered at said entry and exit faces.

3. A magnetic system according to claim 1, wherein said entry and exit faces of each pair of polepieces are at an angle different from 90° with the particle paths at said entry and exit faces, respectively.

4. A magnetic system for regrouping or rearranging the charged particles of an incident beam of such particles so as to provide an exit beam having high density particle bunches, comprising:

an electromagnet including first, second and third pairs of polepieces;

the polepieces being arranged so that the polepieces of said first and third pairs interpenetrate the polepieces of said second pair;

all pairs of polepieces having a common plane of symmetry perpendicular to a first axis defined by the average incident and emergent paths of said beam;

the polepieces defining successive air gaps forming successive first, second, third, fourth, and fifth sectors in which are created, respectively, a first field $H_I$ having a field strenth H/2, a second field $H_{II}$ having a field strength H, a third field $H_{III}$ having field strength H/2, a fourth field $H_{IV}$ having a field strength H and a fifth field $H_V$ having a field strength H/2, the first sector having an entry face ($E_{A1}$) and an exit face ($S_{A1}$), the second sector having an entry face ($E_{B1}$) and an exit face ($S_{B1}$), the third sector having an entry face ($E_D$) and an exit face ($S_D$), the fourth sector having an entry face ($E_{B2}$) and said exit face ($S_{B2}$), the fifth sector having an entry face ($E_{A2}$) and an exit face ($S_{A2}$), said entry face ($S_{A1}$) and exit face ($E_{A2}$) being on an arc of a circle having a radius $r=R_q \cdot tg(\alpha_q/2)$, where $R_q$ and $\alpha_q$ represent respectively the radius of curvature and the deflection angle of the paths in the air gap of said first pair of polepieces for elections having a momentum q;

the successive sectors providing a plurality of loop-like paths for an incident beam entering through entry face ($E_{A1}$) and exiting through exit face ($S_{A2}$), the path length of each path being determined as a function of the momentum q of a particle traveling thereon, the different path lengths resulting in the bunching of particles emerging from exit face ($S_{A2}$), so that they are longitudinally compressed with respect to particles incident at entry face ($E_{A1}$), and with respect to particles incident at entry face ($E_{A1}$); and wherein the electromagnet is provided with an annular coil positioned in the air gap of said first, second, and third polepieces.

5. A magnetic system according to claim 4, wherein said annular coil is formed from two superimposed annular coil elements joined together in said air gaps of said first, second, and third polepieces, said coil elements being spaced from one another in said air gap of said first pair of polepieces so as to provide an opening for the passage of incident and emergent paths of said particles penetrating and leaving said magnetic system.

6. A magnetic system according to claim 5; wherein said annular coil elements are arranged in the peripheral zone of said magnetic system.

7. A magnetic system according to claim 4, wherein said annular coil has an external radius less than the radii of said particle paths of said beam.

* * * * *